US007862134B2

(12) United States Patent
Kaieda et al.

(10) Patent No.: US 7,862,134 B2
(45) Date of Patent: Jan. 4, 2011

(54) LIQUID EJECTING APPARATUS AND METHOD OF DRIVING LIQUID EJECTING HEAD

(75) Inventors: Teruaki Kaieda, Matsumoto (JP); Ryoichi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 147 days.

(21) Appl. No.: 12/410,678

(22) Filed: Mar. 25, 2009

(65) Prior Publication Data

US 2009/0244135 A1 Oct. 1, 2009

(30) Foreign Application Priority Data

Mar. 27, 2008 (JP) ..... 2008-084658

(51) Int. Cl.
*B41J 29/38* (2006.01)

(52) U.S. Cl. ..... 347/9; 347/10

(58) Field of Classification Search ..... 347/9–11, 347/15, 14, 66–68
See application file for complete search history.

(56) References Cited

U.S. PATENT DOCUMENTS 6,494,565 B1 * 12/2002 Ellson et al. ..... 347/46
7,410,233 B2 * 8/2008 Kitami et al. ..... 347/11

FOREIGN PATENT DOCUMENTS

JP 2007-015127 1/2007

* cited by examiner

*Primary Examiner*—Lamson D Nguyen
(74) *Attorney, Agent, or Firm*—Workman Nydegger

(57) ABSTRACT

Provided is a liquid ejecting apparatus including: pressure generation chambers communicating with nozzle openings for ejecting a liquid; and a liquid ejecting head including pressure generation units which cause pressure variations in the pressure generation chambers, wherein idle nozzles including at least one located adjacent to ejection nozzles in the vicinity of the ejection nozzles are selected according to a liquid ejecting timing from the ejection nozzles for ejecting the liquid from the nozzle openings, the pressure generation unit corresponding to the selected idle nozzles is driven, non-ejection driving for pressurizing the pressure generation chamber communicating with the idle nozzles to a degree not ejecting the liquid is performed, and the non-ejection driving is not performed with respect to the pressure generation unit corresponding to the unselected idle nozzles.

8 Claims, 8 Drawing Sheets

LIQUID EJECTING APPARATUS AND METHOD OF DRIVING LIQUID EJECTING HEAD

BACKGROUND

1. Technical Field

The present invention relates to a liquid ejecting apparatus including a liquid ejecting head for ejecting a liquid from nozzle openings and a method of driving a liquid ejecting head.

2. Related Art

An ink jet recording apparatus such as an ink jet printer or plotter includes an ink jet recording head for ejecting an ink stored in an ink storage unit such as an ink cartridge or an ink tank as ink droplets.

The ink jet recording head includes pressure generation chambers communicating with nozzle openings, a reservoir which is a common liquid chamber communicating with the plurality of pressure generation chambers, and pressure generation units for causing a pressure variation in the pressure generation chambers and ejecting ink droplets from the nozzle openings. As the pressure generation units mounted in the ink jet recording head, for example, a longitudinal vibration piezoelectric element, a deflection piezoelectric element, a device using electrostatic force, a heating device or the like may be used.

In such an ink jet recording head, when an ink is ejected from any nozzle opening, a partition wall defining the pressure generation chamber is deflected and deformed to the adjacent pressure generation chamber side by a pressure variation of the ink of the pressure generation chamber by the operation of the pressure generation units. Thus, pressure loss may be generated and a variation in ejection characteristic such as the deterioration of the flight speed of the ink or the reduction of the ejection amount of the ink may occur. In addition to the pressure loss due to the deformation of the partition wall defining the pressure generation chamber, such pressure loss is generated between the pressure generation chamber and the reservoir.

Accordingly, a liquid ejecting apparatus for driving pressure generation units corresponding to idle nozzles located adjacent to ejection nozzles to a degree not ejecting an ink, according to an ejection timing of the ejection nozzles for ejecting the ink is suggested (for example, see JP-A-2007-15127).

However, in JP-A-2007-15127, when all the idle nozzles excluding the ejection nozzles for ejecting the ink are driven to a degree not ejecting the ink, power consumption is increased.

Such a problem occurs even in a liquid ejecting apparatus for ejecting a liquid excluding an ink as well as the ink jet recording apparatus.

SUMMARY

An advantage of some aspects of the invention is that it provides a liquid ejecting apparatus and a method of driving a liquid ejecting head, which are capable of always making a liquid ejection characteristic constant regardless of the number of nozzle openings for ejecting a liquid and reducing power consumption.

According to an aspect of the invention, there is provided a liquid ejecting apparatus including: pressure generation chambers communicating with nozzle openings for ejecting a liquid; and a liquid ejecting head including pressure generation units which cause pressure variations in the pressure generation chambers, wherein idle nozzles including at least one located adjacent to ejection nozzles in the vicinity of the ejection nozzles are selected according to a liquid ejecting timing from the ejection nozzles for ejecting the liquid from the nozzle openings, the pressure generation unit corresponding to the selected idle nozzles is driven, non-ejection driving for pressurizing the pressure generation chamber communicating with the idle nozzles to a degree not ejecting the liquid is performed, and the non-ejection driving is not performed with respect to the pressure generation unit corresponding to the unselected idle nozzles.

In such an aspect, by performing the non-ejection driving with respect to the pressure generation unit corresponding to at least one idle nozzle located adjacent to the ejection nozzles according to the ejection timings of the liquid droplets from the ejection nozzles, it is possible to reduce pressure loss. Accordingly, it is possible to suppress a variation in ejection characteristic such as the deterioration of the flight speed of the liquid droplets, the reduction of the amount of liquid droplets or the like regardless of the number or the positions of the nozzle openings for ejecting the liquid droplets and to uniformize the ejection characteristic. Since the non-ejection driving is not performed with respect to all the idle nozzles, it is possible to reduce power consumption.

The non-ejection driving may be performed with respect to the pressure generation unit corresponding to 10 idle nozzles at both sides of each of the ejection nozzles. Accordingly, it is possible to suppress the variation in ejection characteristic of the liquid droplets with certainty and to reduce power consumption.

The liquid ejecting apparatus may further include a driving signal generation unit which simultaneously and repeatedly generates a plurality of driving signals in every ejection period and a selection supply unit which selects pulses included in the driving signals generated from the driving signal generation unit and supplies the pulses to the pressure generation unit, the driving signal generation unit may generate a non-ejection driving signal including non-ejection pulses for causing the pressure variation to a degree not ejecting the liquid from the nozzle openings in the liquid of the pressure generation chamber, in the non-ejection driving signal, the non-ejection pulses may be arranged in correspondence with the ejection pulses included in another driving signal, and the selection supply unit may supply the non-ejection pulses to the pressure generation unit corresponding to the selected idle nozzles according to the supply timing of the ejection pulses to the pressure generation unit corresponding to the ejection nozzles. Accordingly, it is possible to selectively the supply/non-supply of the non-ejection pulses to the pressure generation unit corresponding to the idle nozzles according to the supply timing of the ejection pulses to the pressure generation unit corresponding to the ejection nozzles.

The driving signal generation unit may generate different types of ejection pulses and may arrange the non-ejection pulses in correspondence with the generation periods of the ejection pulses.

The timing of a contraction element of the pressure generation chamber by the non-ejection pulses may be aligned with the timing of a contraction element of the pressure generation chamber of the ejection pulses corresponding thereto. Accordingly, since the pressurization of the liquid of the pressure generation chamber is simultaneously performed by the ejection nozzles and the idle nozzles for performing the non-ejection driving, it is possible to reduce the pressure loss to the pressure generation chamber of the idle nozzles from the pressure generation chamber of the ejection nozzles with certainty.

The non-ejection pulses may be minute vibration pulses for minutely vibrating the surface of the liquid exposed by the nozzle openings to a degree not ejecting the liquid. Accordingly, since the existing minute vibration pulses are used as the non-ejection pulses, it is possible to realize a configuration for preventing crosstalk by performing a simple design change with respect to the existing liquid ejecting apparatus which can perform ejection control using a plurality of driving signals.

The non-ejection pulses may be counter pulses for reducing the driving voltage of the ejection pulses corresponding thereto to a degree not ejecting the liquid. Accordingly, since the timings for causing the pressure variations to the liquid of the pressure generation chamber can be matched by the ejection pulses and the non-ejection pulses, it is possible to more efficiently suppress pressure loss.

According to another aspect of the invention, there is provided a method of driving a liquid ejecting head including pressure generation chambers communicating with nozzle openings for ejecting a liquid, and a liquid ejecting head including pressure generation units which cause pressure variations in the pressure generation chambers, wherein idle nozzles including at least one located adjacent to ejection nozzles in the vicinity of the ejection nozzles are selected according to a liquid ejecting timing from the ejection nozzles for ejecting the liquid from the nozzle openings, the pressure generation unit corresponding to the selected idle nozzles is driven, non-ejection driving for pressurizing the pressure generation chamber communicating with the idle nozzles to a degree not ejecting the liquid is performed, and the non-ejection driving is not performed with respect to the pressure generation unit corresponding to the unselected idle nozzles.

In such an aspect, by performing the non-ejection driving with respect to the pressure generation unit corresponding to the idle nozzles located adjacent to the ejection nozzles according to the ejection timings of the liquid droplets from the ejection nozzles, it is possible to reduce pressure loss. Accordingly, it is possible to suppress a variation in ejection characteristic such as the deterioration of the flight speed of the liquid droplets, the reduction of the amount of liquid droplets or the like regardless of the number or the positions of the nozzle openings for ejecting the liquid droplets and to uniformize the ejection characteristic. Since the non-ejection driving is not performed with respect to all the idle nozzles, it is possible to reduce power consumption.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the invention will be described in detail with reference to the accompanying drawings.

Embodiment 1

Figure 1:
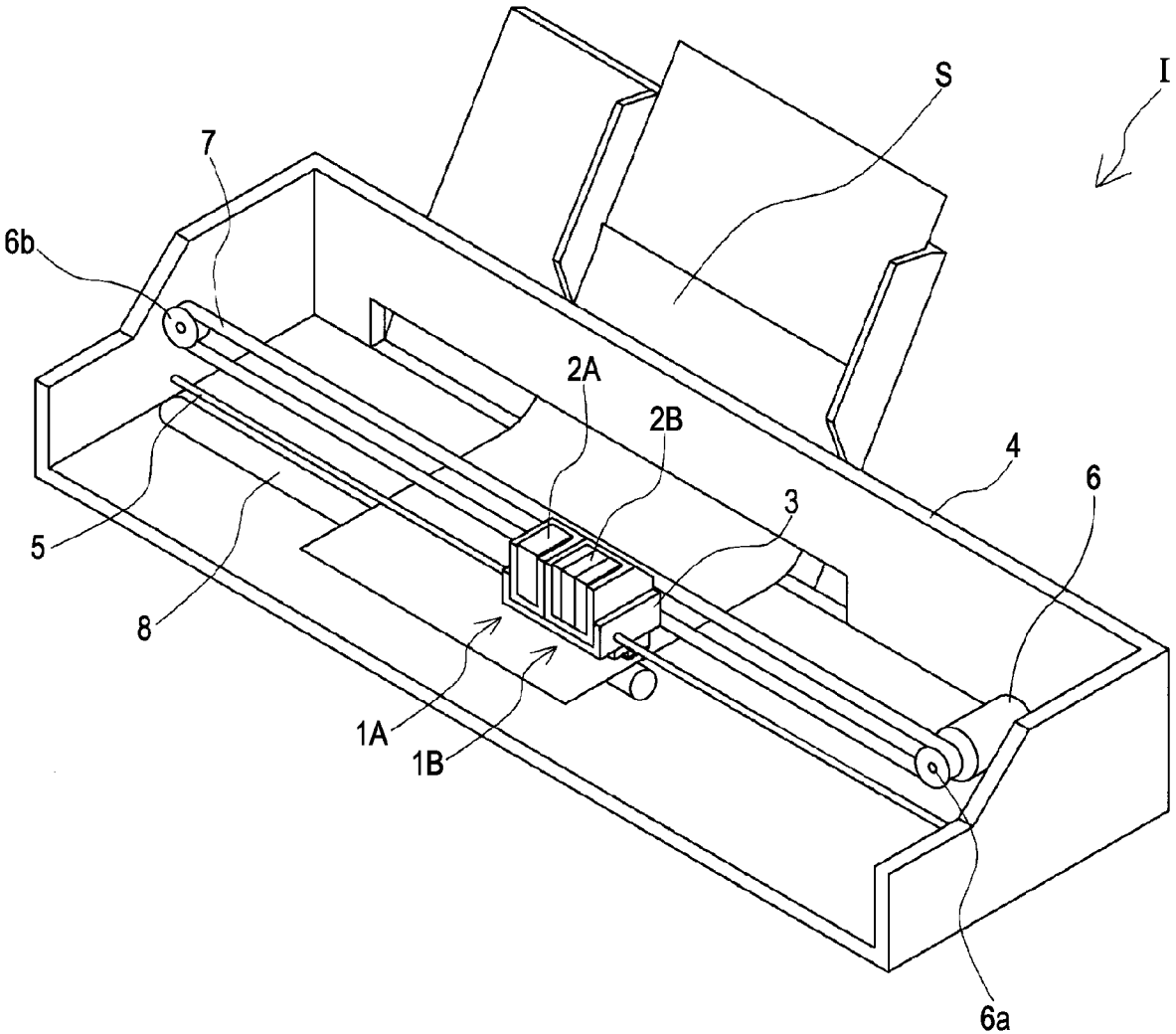
FIG. 1 is a schematic perspective view of a recording apparatus according to Embodiment 1 of the invention.

FIG. 1 is a schematic perspective view of an ink jet recording apparatus which is an example of liquid ejecting apparatus according to an embodiment of the invention.

The liquid ejecting apparatus according to the present embodiment is, for example, an ink jet recording apparatus. In detail, as shown in FIG. 1, ink cartridges 2A and 2B configuring an ink supply unit are detachably provided in recoding head units 1A and 1B each including an ink jet recording head which will be described below, and a carriage 3 in which the recording head units 1A and 1B are mounted is axially movably provided on a carriage shaft 5 mounted in an apparatus body 4. The recording head units 1A and 1B eject a black ink composition and a color ink composition, respectively.

A driving motor 6 is provided in the vicinity of one end of the carriage shaft 5, a first pulley 6*a* having a groove in an outer circumference thereof is provided on a front end of the shaft of the driving motor 6. In addition, a second pulley 6*b* corresponding to the first pulley 6*a* of the driving motor 6 is rotatably provided in the vicinity of the other end of the carriage shaft 5, and a timing belt 7 formed of an elastic member such as rubber is stretched between the first pulley 6*a* and the second pulley 6*b* in an annular shape.

In addition, the driving force of the driving motor 6 is delivered to the carriage 3 via the timing belt 7 such that the carriage 3 in which the recording head units 1A and 1B are mounted is moved along the carriage shaft 5. A platen 8 is provided in the apparatus body 4 along the carriage 3. This platen 8 can be rotated by the driving force of a paper feed motor (not shown) and a recording sheet S which is a recording medium such as paper fed by a feed roller or the like is wound by the platen 8 and is transported.

Figure 2:
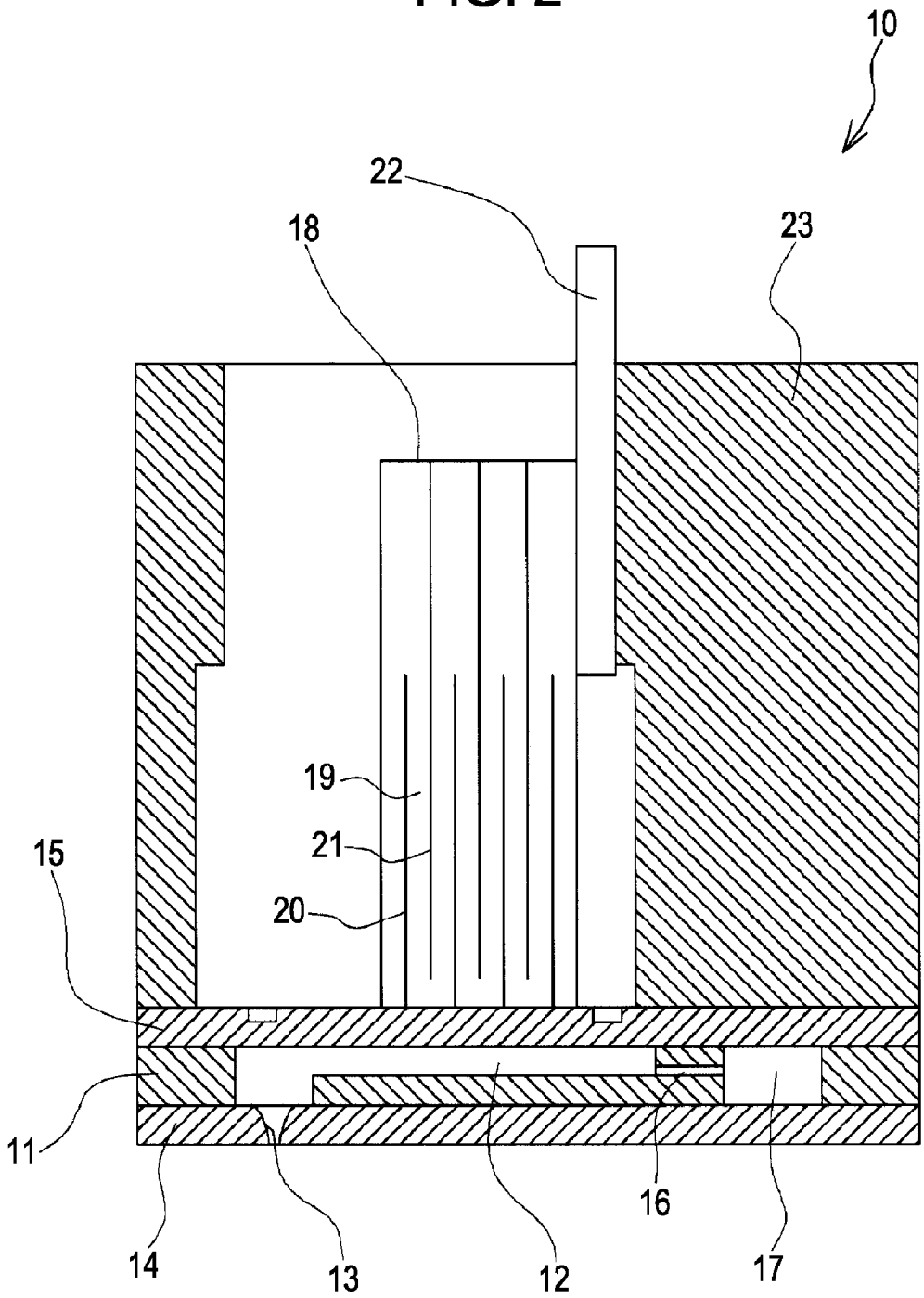
FIG. 2 is a cross-sectional view of a recording head according to Embodiment 1 of the invention.

Now, the ink jet recording head mounted in the above-described ink jet recording apparatus I will be described. FIG. 2 is a cross-sectional view of an example of an ink jet recording head according to Embodiment 1 of the invention.

The ink jet recording head 10 shown in FIG. 2 has a longitudinal vibration piezoelectric element. A plurality of pressure generation chambers 12 are arranged in parallel on a channel substrate 11. Both sides of the channel substrate 11 are sealed by a nozzle plate 14 having nozzle openings 13 in correspondence with the pressure generation chambers 12, and a vibration plate 15. A reservoir 17 which communicates with the pressure generation chambers 12 via ink supply ports 16 and becomes a common ink chamber of the plurality of pressure generation chambers 12 is formed in the channel substrate 11, and an ink cartridge (not shown) are connected to the reservoir 17.

Meanwhile, the front ends of piezoelectric elements 18 are provided to be in contact with areas corresponding to the pressure generation chambers 12 on the side opposite to the pressure generation chambers 12 of the vibration plate 15. These piezoelectric elements 18 are laminated by alternatively sandwiching a piezoelectric material 19 and electrode forming materials 20 and 21 in a vertical direction such an inactive region which does not contribute to vibration is adhered to a fixed substrate 22. In addition, the fixed substrate 22, the vibration plate 15, the channel substrate 11 and the nozzle plate 14 are integrally fixed through a base member 23.

In the ink jet recording head 10 having the above-described configuration, the ink is supplied to the reservoir 17 via an ink channel communicating with the ink cartridge and is distributed to the pressure generation chambers 12 via the ink supply ports 16. Actually, a voltage is applied to the piezoelectric elements 18 such that the piezoelectric elements 18 contract. Accordingly, the vibration plate 15 is deformed together with the piezoelectric devices 18 (is lifted up in the upward direction of the drawing), the volumes of the pressure chambers 12 are increased, and the ink is introduced into the pressure generation chambers 12. Then, when the ink is filled in the pressure generation chambers until reaching the nozzle openings 13 and the voltage applied to the electrode forming materials 20 and 21 of the piezoelectric elements 18 is then released according to a recording signal from a driving circuit, the piezoelectric elements 18 expand and return to an original state. Accordingly, since the vibration plate 15 is also displaced and returned to an original state, the pressure generation chambers 12 contract, internal pressure is increased, and ink droplets are ejected from the nozzle openings 13. That is, in the present embodiment, the longitudinal vibration piezoelectric elements 18 are provided as the pressure generation units for causing the pressure variation in the pressure generation chambers 12.

Figure 3:
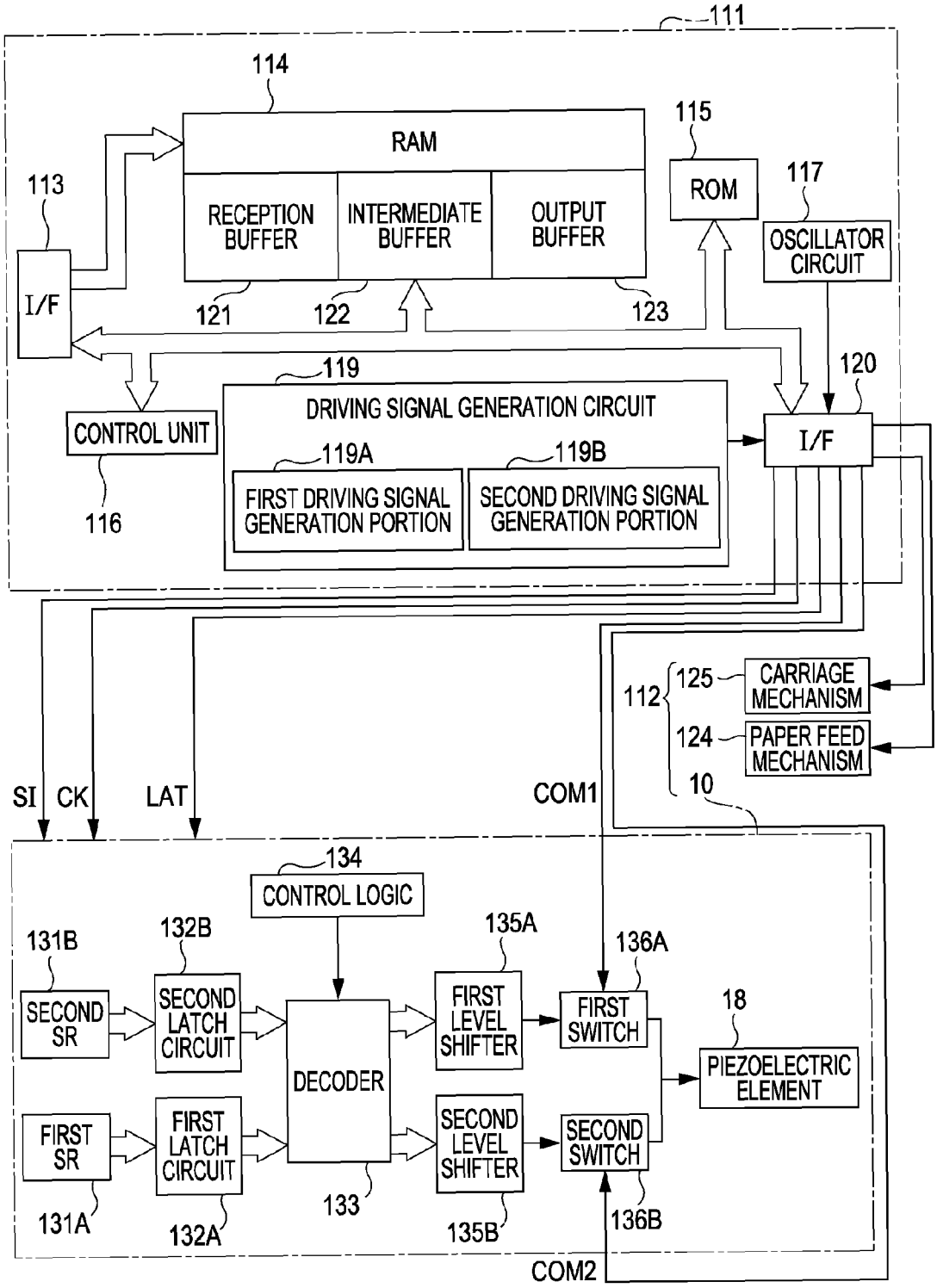
FIG. 3 is a block diagram showing the control configuration of the recording apparatus according to Embodiment 1 of the invention.

FIG. 3 is a block diagram showing the control configuration of the ink jet recording apparatus. Now, the control of the ink jet recording apparatus I according to the present embodiment will be described with reference to FIG. 3. As shown in FIG. 3, the ink jet recording apparatus I according to the present embodiment includes a printer controller 111 and a print engine 112. The printer controller 111 includes an external interface 113 (hereinafter, referred to as an external I/F 113), a RAM 114 for temporarily storing a variety of data, a ROM 115 for storing a control program or the like, a control unit 116 including a CPU or the like, an oscillator circuit 117 for generating a clock signal, a driving signal generation circuit 119 for generating a driving signal supplied to the ink jet recording head 10, and an internal interface 120 (hereinafter, referred to as an internal I/F 120) for transmitting dot pattern data (bitmap data) or the like developed on the basis of the driving signal or printing data to a print engine 112.

The external I/F 113 receives, for example, the printing data including a character code, a graphic function, image data or the like from a host computer (not shown) or the like. A busy signal (BUSY) or an acknowledgement signal (ACK) is output to the host computer or the like via the external I/F 113. The RAM 114 functions as a reception buffer 121, an intermediate buffer 122, an output buffer 123 and a work memory (not shown). The reception buffer 121 temporarily stores the printing data received by the external I/F 113, the intermediate buffer 122 stores intermediate code data converted by the control unit 116, and the output buffer 123 stores dot pattern data. This dot pattern data is configured by printing data which can be obtained by decoding (translating) gradation data.

Figure 4:
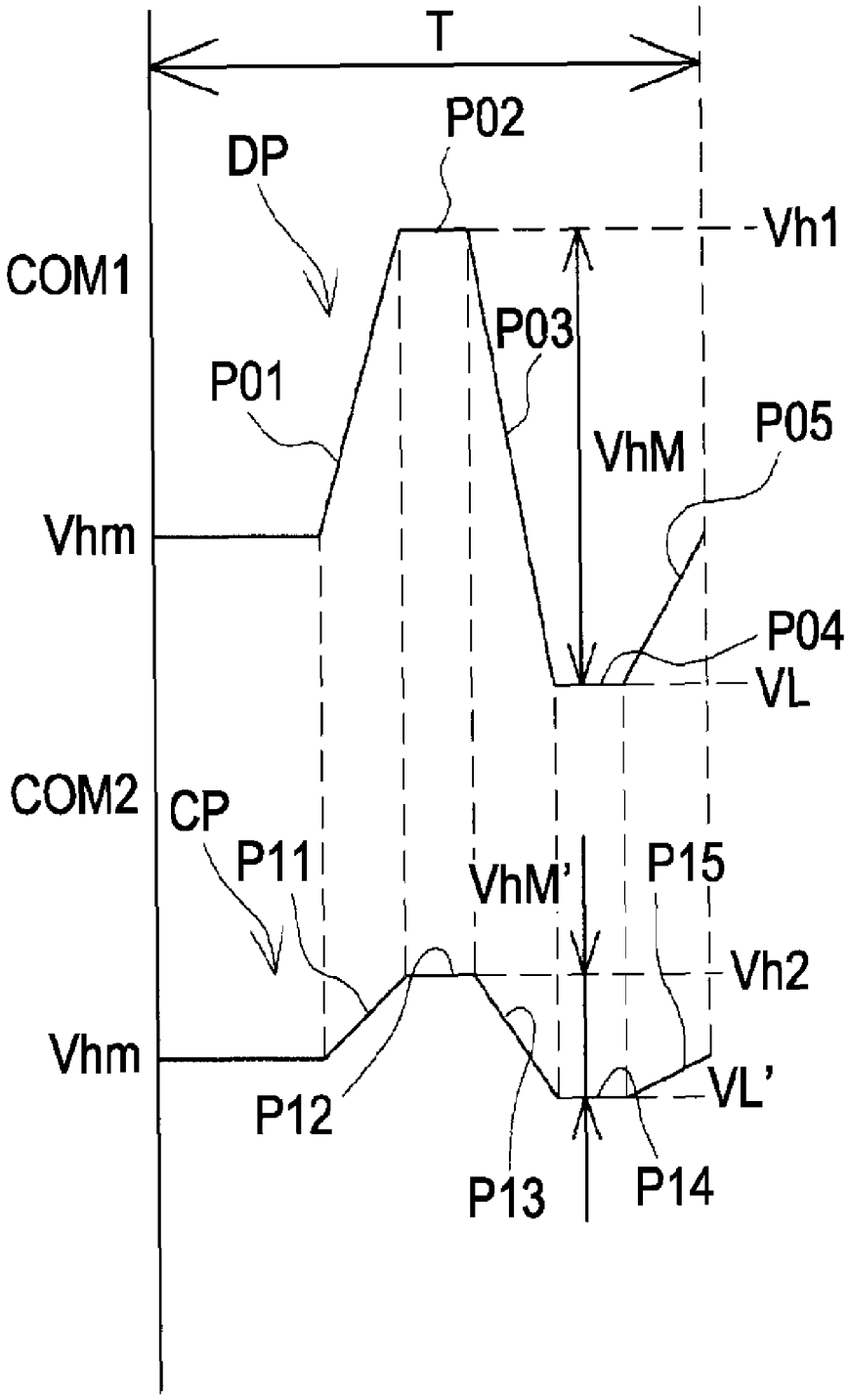
FIG. 4 is a waveform diagram showing an example of a driving signal according to Embodiment 1 of the invention.

The driving signal generation circuit 119 corresponds to a driving signal generation unit of the invention and includes a first driving signal generation portion 119A (first driving signal generation unit) for generating a first driving signal COM1 and a second driving signal generation portion 119B (second driving signal generation unit) for generating a second driving signal COM2. As shown in FIG. 4, the first driving signal COM1 is a signal having an ejection pulse DP for driving (ejection driving) the piezoelectric elements 18 so as to eject the ink in one recording period T, and is repeatedly generated in every recording period T.

Meanwhile, the second driving signal COM2 is a signal having a counter pulse CP which is a non-ejection pulse for driving (non-ejection driving) the piezoelectric elements 18 to a degree not ejecting the ink in one recording period T in correspondence with the ejection pulse DP, and is repeatedly generated in every recording period T, similar to the first driving signal COM1. The recording period T is a repetition unit of a driving signal COM and is an ejection period of the invention. The details of such driving signals COM1 and COM2 will be described later.

Font data, graphic function or the like is stored in the ROM 115 in addition to the control program (control routine) for performing a variety of data processes. The control unit 116 reads the printing data from the reception buffer 121 and stores the intermediate code data obtained by converting this printing data in the intermediate buffer 122. The intermediate code data read from the intermediate buffer 122 is analyzed, and the intermediate code data is developed to the dot pattern data by referring to the font data, the graphic function or the like stored in the ROM 115. The control unit 116 performs a necessary decoration process and stores the developed dot pattern data in the output buffer 123.

If dot pattern data corresponding to one row of the liquid ejecting head 118 is obtained, the dot pattern data of one row is output to the liquid ejecting head 118 via the internal I/F 120. In addition, when the dot pattern data of one row is output from the output buffer 123, developed intermediate code data is erased from the intermediate buffer 122 and a development process for next intermediate code data is performed.

The print engine 112 includes the ink jet recording head 10, a paper feed mechanism 124 and a carriage mechanism 125. The paper feed mechanism 124 includes a paper feed motor, the platen 8 and so on and sequentially feeds a recording sheet S such as recording paper in interlocking with a recording operation of the ink jet recording head 10. That is, the paper feed mechanism 124 relatively moves the recording sheet S in a sub scanning direction.

The carriage mechanism 125 includes the carriage 3 in which the ink jet recording head 10 is mounted and a carriage driving unit for running the carriage 3 in a main scanning direction, and runs the carriage 3 so as to move the ink jet recording head 10 in the main scanning direction. The carriage driving unit includes the driving motor 6, the timing belt 7 and so on as described above.

The ink jet recording head 10 has a plurality of nozzle openings 13 along the sub scanning direction and ejects liquid droplets from the nozzle openings 13 at timings defined by the dot pattern data or the like. An electrical signal, for example, a driving signal (COM1 and COM2) or printing data (SI) or the like is supplied to the piezoelectric elements 18 of the ink jet recording head 10 via an external wire (not shown).

Now, the electrical configuration of the ink jet recording head 10 of the present embodiment will be described. As shown in FIG. 3, the ink jet recording head 10 includes a shift register circuit including a first shift register 131A and a second shift register 131B, a latch circuit including a first latch circuit 132A and a second latch circuit 132B, a decoder 133, a control logic 134, a level shifter circuit including a first level shifter 135A and a second level shifter 135B, a switch circuit including a first switch 136A and a second switch 136B, and a piezoelectric element 18. The shift registers 131A and 131B, the latch circuits 132A and 132B, the level shifters 135A and 135B, the switches 136A and 136B and the piezoelectric element 18 are provided in correspondence with the nozzle openings 13.

This ink jet recording head 10 ejects ink droplets on the basis of recording data from the printer controller 111. In the present embodiment, since a high-level bit group and a low-level bit group of the recording data are sent to the ink jet recording head 10 in this order, first, the high-level bit group of the recording data is set in the second shift register 131B. When the high-level bit group of the recording data is set in the second shift register 131B with respect to all the nozzle openings 13, the high-level bit group is shifted to the first shift register 131A. Simultaneously the low-level bit group of the recording data is set in the second shift register 131B.

The first latch circuit 132A is electrically connected to the back end of the first shift register 131A and the second latch circuit 132B is electrically connected to the back end of the second shift register 131B. When the latch signal (LAT) from the printer controller 111 is input to the latch circuits 132A and 132B, the first latch circuit 132A latches the high-level bit group of the recording data and the second latch circuit 132B latches the low-level bit group of the recording data. The recording data (the high-level bit group and the low-level bit group) latched in the latch circuits 132A and 132B is output to the decoder 133, respectively. This decoder 133 generates a pulse selection data for selecting the pulses configuring the driving signals COM1 and COM2 on the basis of the high-level bit group and the low-level bit group of the recording data.

The pulse selection data is generated in each of the driving signals COM1 and COM2. That is, the first pulse selection data corresponding to the first driving signal COM1 is configured by data of one bit. In addition, the second pulse selection data corresponding to the second driving signal COM2 is configured by data of one bit.

A timing signal from the control logic 134 is also input to the decoder 133. This control logic 134 generates a timing signal in synchronization of the input of a latch signal or a channel signal. This timing signal is also generated in each of the driving signals COM1 and COM2. The pulse selection data generated by the decoder 133 is sequentially input to the level shifters 135A and 135B from the high-level bit side at timings defined by the timing signal. These level shifters 135A and 135B function as voltage amplifiers and output voltage values for driving the switches 136A and 136B corresponding thereto, for example, electrical signals boosted to several tens volts, if the pulse selection data is "1". That is, if the first pulse selection data is "1", the electrical signal is output to the first switch 136A and, if the second pulse selection data is "1", the electrical signal is output to the second switch 136B, such that the switch becomes a connection state.

The first driving signal COM1 from the first driving signal generation portion 119A is supplied to the input side of the first switch 136A, and the second driving signal COM2 from the second driving signal generation portion 119B is supplied to the input side of the second switch 136B. The piezoelectric element 18 is electrically connected to the output sides of the switches 136A and 136B. The first switch 136A and the second switch 136B are provided in every kind of the generated driving signal and are interposed between the driving signal generation circuit 119 and the piezoelectric element 18 so as to selectively supply the driving signals COM1 and COM2 to the piezoelectric element 18. The first switch 136A and the second switch 136B function as selection supply units in the present embodiment. When both the first switch 136A and the second switch 136B are disconnected, the driving signals COM1 and COM2 are not supplied to the piezoelectric element 18. Accordingly, the selection supply unit selectively supplies the driving signals COM1 and COM2 to the piezoelectric element 18 and does not supply the driving signals COM1 and COM2 to the piezoelectric element 18.

The pulse selection data controls the operations of the switches 136A and 136B. That is, in a period in which the pulse selection data input to the first switch 136A is "1", the first switch 136A becomes the connection state and the first driving signal COM1 is supplied to the piezoelectric element 18. Similarly, in a period in which the pulse selection data input to the second switch 136B is "1", the second switch 136B becomes the connection state and the second driving signal COM2 is supplied to the piezoelectric element 18. The voltage applied to the piezoelectric element 18 is changed according to the supplied driving signals COM1 and COM2. Meanwhile, in a period in which all the pulse selection data input to the switches 136A and 136B is "0", the switches 136A and 136B becomes a disconnection state and the driving signals COM1 and COM2 are not supplied to the piezoelectric element 18. For example, the pulse of the period in which the pulse selection data is set to "1" is selectively supplied to the piezoelectric element 18. In the period in which all the pulse selection data is "0", since the piezoelectric element 18 holds a preceding potential, a preceding displacement state is held.

In the present embodiment, the decoder 133, the control logic 134, the level shifters 135A and 135B and the switches 136A and 136B function as the pressure generation unit control unit, and controls the behavior of the piezoelectric element 18 by controlling the supply of the driving signals COM1 and COM2 according to the recording data (gradation data).

Next, the driving signals COM1 and COM2 generated by the driving signal generation circuit 119 and the control of the supply of the driving signals COM1 and COM2 to the piezoelectric element 18 will be described.

The driving signal shown in FIG. 4 includes the first driving signal COM1 and the second driving signal COM2 as described above.

The first driving signal COM1 includes the ejection pulse DP generated in one recording period T. The ejection pulse DP includes a first expansion element P01 for rising from a state of holding an intermediate potential Vhm to a first expansion potential Vh1 to expand the pressure generation chamber 12, a first hold element P02 for holding the first expansion potential Vh1 during a predetermined time, a first contraction element P03 for falling from the first expansion potential Vh1 to a first contraction potential VL with a sharp gradient to contract the pressure generation chamber 12, a second hold element P04 for holding the first contraction potential VL during a predetermined time, and a first vibration attenuating element P05 for returning from the first contraction potential VL to the intermediate potential Vhm with a constant gradient of a degree not ejecting the ink droplets.

When the first driving signal COM1 is supplied to the piezoelectric element 18, the piezoelectric element 18 is deformed by the first expansion element P01 in a direction in which the volume of the pressure generation chamber 12 expands, the meniscus in the nozzle opening 13 is drawn into the pressure generation chamber 12, and the ink is supplied from the reservoir 17 to the pressure generation chamber 12. The expansion state of the pressure generation chamber 12 is held by the first hold element P02. Thereafter, the first contraction element P03 is supplied such that the piezoelectric element 18 expands. Accordingly, the pressure generation chamber 12 rapidly contracts from an expansion volume to a contraction volume corresponding to the first contraction potential VL, and the ink in the pressure generation chamber 12 is pressurized such that the ink droplets are ejected from the nozzle opening 13. The contraction state of the pressure generation chamber 12 is held by the second hold element P04, and the ink pressure in the pressure generation chamber 12 previously reduced by the ejection of the ink droplet rises by the inherent vibration again. According to this rising timing, the first vibration attenuating element P05 is supplied, the pressure generation chamber 12 returns to a reference volume, and a pressure variation in the pressure generation chamber 12 is absorbed. That is, the ejection pulse DP generated in the driving signal COM1 of the present embodiment is of a push-pull type.

The second driving signal COM2 functions as a non-ejection driving signal and includes a counter pulse CP which is a non-ejection pulse generated in one recording period T. The counter pulse indicates a pulse for falling a driving voltage (a potential difference from a lowest potential to a highest potential) of a corresponding ejection pulse DP to a voltage of a degree not ejecting the ink from the nozzle opening 13, and has a shape obtained by reducing the corresponding ejection pulse DP in a vertical direction (voltage variation axis direction).

In detail, the counter pulse CP includes a second expansion element P11 for rising from the intermediate potential Vhm to a second expansion potential Vh2 to expand the pressure generation chamber 12, a third hold element P12 for holding the second expansion potential Vh2, a second contraction element P13 for falling from the second expansion potential Vh2 to a second contraction potential VL' to contract the pressure generation chamber, a fourth hold element P14 for holding the second contraction potential VL' during a predetermined time, and a second vibration attenuating element P15 for returning from the second contraction potential VL' to the intermediate potential Vhm.

In such a counter pulse CP, the potentials Vh2 and VL' are set such that the ink is not ejected. In addition, the generation periods of the waveform elements P11 to P15 of the counter pulse CP are respectively equal to those of the waveform elements P01 to P05 of the ejection pulse DP, as shown in FIG. 4. A driving voltage VhM' of the counter pulse CP is set to 10 to 50% of a driving voltage VhM of the ejection pulse DP. Accordingly, the inclination of the waveform elements P11, P13 and P15 are more moderate than the inclination of the waveform elements P01, P03 and P05 corresponding thereto.

Now, the ejection driving for driving the piezoelectric element 18 by the first driving signal COM1 to a degree not ejecting the ink droplets, the non-ejection driving for driving the piezoelectric element 18 by the second driving signal COM2 to a degree not ejecting the ink droplets, and the non-driving in which the first driving signal COM1 and the second driving signal COM2 are not supplied to the piezoelectric element 18 and a pressure variation is not performed with respect to the piezoelectric element 18 will be described.

First, the non-driving will be described. In the non-driving, the decoder 133 generates first waveform selection data "0" and second waveform selection data "0" by the translation of gradation data "00" of the non-driving. The pressure generation unit control unit controls the operations of the first switch 136A and the second switch 136B on the basis of this waveform selection data. That is, the pressure generation unit control unit controls both the first switch 136A and the second switch 136B to become the disconnection state. Accordingly, in the recording period T, the ejection pulse DP of the first driving signal COM1 and the counter pulse CP of the second driving signal COM2 are not supplied to the piezoelectric element 18 and the piezoelectric element 18 is held in a state in which the intermediate potential Vhm is applied.

Next, the ejection driving will be described. In the ejection driving, the decoder 133 generates first waveform selection data "1" and second waveform selection data "0" by the translation of gradation data "10" of the ejection driving. The pressure generation unit control unit controls the supply of the first driving signal COM1 and the second driving signal COM2 to the piezoelectric element 18 on the basis of the generated waveform selection data. That is, in the recording period T, the first switch 136A is controlled to the connection state and the second switch 136B is controlled to the disconnection state. Accordingly, the ejection pulse DP of the first driving signal COM1 is supplied to the piezoelectric element 18 such that the ink droplets are ejected from the nozzle openings 13.

Next, the non-ejection driving will be described. In the non-ejection driving, the decoder 133 generates first waveform selection data "0" and second waveform selection data "1" by the translation of gradation data "01" of the non-ejection driving. The pressure generation unit control unit controls the supply of the first driving signal COM1 and the second driving signal COM2 to the piezoelectric element 18 on the basis of the generated waveform selection data. That is, in the recording period T, the first switch 136A is controlled to the disconnection state and the second switch 136B is controlled to the connection state. Accordingly, the counter pulse CP of the second driving signal COM2 is supplied to the piezoelectric element 18 and the piezoelectric element 18 generates a pressure variation in the ink in the pressure generation chamber 12 to a degree not ejecting the ink droplets.

The ejection driving, the non-ejection driving and the non-driving of the piezoelectric element 18 are properly selectively performed with respect to the ejection nozzles for ejecting the ink droplets, idle nozzles including at least one located adjacent to the ejection nozzle in the vicinity of the ejection nozzle, and the other idle nozzles.

In detail, the ejection pulse DP of the first driving signal COM1 is supplied to the piezoelectric element 18 corresponding to the ejection nozzles for ejecting the ink droplets such that the piezoelectric element 18 performs the ejection driving.

The counter pulse CP which is the non-ejection pulse of the second driving signal COM2 is supplied to the piezoelectric element 18 corresponding to the idle nozzles including at least one located adjacent to the ejection nozzles in the vicinity of the ejection nozzles according to a supply timing of the ejection pulse DP to the piezoelectric element 18 corresponding to the ejection nozzles such that the piezoelectric element 18 performs the non-ejection driving. The idle nozzles including at least one located adjacent to the ejection nozzle in the vicinity of the ejection nozzle for performing the non-ejection driving indicates that only the idle nozzles located adjacent to the ejection nozzles are present in the idle nozzles which do not eject the ink simultaneously with the ejection nozzles or the number of idle nozzles located adjacent to the idle nozzles located adjacent to the ejection nozzle is plural.

The first driving signal COM1 and the second driving signal COM2 are not supplied to the piezoelectric element 18 corresponding to the idle nozzles excluding the idle nozzles for non-ejection driving in the plurality of idle nozzles according to the supply timing of the ejection pulse to the piezoelectric element 18 corresponding to the ejection nozzles such that the piezoelectric element 18 performs the non-driving.

That is, at least one idle nozzle located adjacent to the ejection nozzle is selected from the plurality of idle nozzles according to the supply timing of the ejection pulse to the piezoelectric element 18 corresponding to the ejection nozzles such that the piezoelectric element 18 corresponding to the selected idle nozzle performs the non-ejection driving and the piezoelectric element 18 corresponding to the unselected idle nozzles does not perform the non-ejection driving.

The recording control is performed using the driving signal COM1 and COM2 as described above. The counter pulse CP which is the non-ejection pulse is supplied to the piezoelectric element 18 corresponding to the selected idle nozzles located adjacent to the ejection nozzle according to the supply timing of the ejection pulse DP to the piezoelectric element 18 corresponding to the ejection nozzles. Accordingly, the piezoelectric element 18 corresponding to the selected idle nozzles is driven (expanded) according to the ejection timing of the ink droplets from the ejection nozzles, and the ink of the pressure generation chamber 12 of the selected idle nozzles is pressurized to a degree not ejecting the ink droplets. That is, the pressurization to the ink in the pressure generation chamber 12 is simultaneously performed by the ejection nozzles and the selected idle nozzles. By this pressurization, it is possible to reduce the pressure loss of the selected adjacent idle nozzles from the pressure generation chamber 12 of the ejection nozzles to the pressure generation chamber 12. As a result, it is possible to suppress a variation in ejection characteristic such as the deterioration of the flight speed of the ink droplets or the reduction of the amount of ink droplets and to prevent crosstalk. Accordingly, the ejection characteristic of the ink droplets can be constantly adjusted when the ejection is simultaneously performed in the nozzle openings 13 adjacent to the ejection nozzle (when the nozzles located adjacent to the ejection nozzle are ejection nozzles) and when the ejection is not simultaneously performed in the nozzle openings 13 adjacent to the ejection nozzle (when the nozzles adjacent to the ejection nozzle are idle nozzles).

When the idle pulses are not supplied to the piezoelectric element 18 corresponding to the idle nozzles, factors for causing the pressure loss (crosstalk) of the pressure generation chamber 12 communicating with the ejection nozzles are as follows.

As a first factor, when the driving signal COM1 is supplied to the piezoelectric element 18 corresponding to the ejection nozzles, the pressure generation chamber 12 corresponding to the ejection nozzles vibrates by the driving of the piezoelectric element 18, this vibration propagates to the pressure generation chamber 12 corresponding to the adjacent idle nozzles such that ejection power is lost. That is, by the deflection of the partition wall between adjacent pressure generation chambers 12, the pressure in the pressure generation chamber 12 communicating with the ejection nozzles propagates to the pressure generation chamber 12 corresponding to the adjacent idle nozzles through the partition wall such that pressure loss is generated.

As a second factor, when the driving signal COM1 is supplied to the piezoelectric elements 18 corresponding to a plurality of ejection nozzles, the pressure generation chambers 12 communicating with the ejection nozzles vibrate by the driving of the piezoelectric elements 18, but all the pressure generation chambers 12 are deflected by this vibration. Since a deflection variation ratio of all the pressure generation chambers 12 is changed by the number of pressure generation chambers 12 (the number of ejection nozzles corresponding thereto) due to the driving of the piezoelectric elements 18, ejection power is lost. That is, pressure loss is generated by the deflection of all the pressure generation chambers 12.

As a third factor, due to the vibration of the pressure generation chamber 12 corresponding to the ejection nozzles, ejection power is lost through the reservoir/shape.

As a fourth factor, due to a difference in the number of driven piezoelectric elements 18 corresponding to the ejection nozzles, a variation occurs in displacement amounts of the piezoelectric elements 18 due to the electric effect such as a voltage drop, and thus pressure loss is generated.

In the invention, as a countermeasure against the first factor, by supplying the non-ejection driving signal (non-ejection pulse) to the piezoelectric element 18 corresponding to the idle nozzles adjacent to the ejection nozzles, a vibration occurs in the pressure generation chamber 12 corresponding to the idle nozzles and the vibration propagates toward the pressure generation chamber 12 corresponding to the ejection nozzles. Meanwhile, since the vibration propagates from the pressure generation chamber 12 corresponding to the ejection nozzles toward the pressure generation chamber 12 corresponding to the idle nozzles, both vibrations are mutually canceled and the partition wall between the adjacent pressure generation chambers 12 is fixed such that the loss of the ejection power (crosstalk between the pressure generation chambers 12 with the partition wall interposed therebetween) can be reduced.

In the invention, as a countermeasure against the second factor, by supplying the non-ejection driving signal (non-ejection pulse) to the piezoelectric elements 18 corresponding to a plurality of idle nozzles, the pressure generation chambers 12 of a plurality of non-ejection nozzles vibrate together with the pressure generation chambers 12 of the ejection nozzles such that all the pressure generation chambers 12 are deflected. That is, by vibrating the pressure generation chamber 12 communicating with the idle nozzles, it is possible to suppress a variation in the deflection of all the pressure generation chambers 12 (suppress a deflection variation ratio) until all the pressure generation chambers 12 are distorted.

As a countermeasure against the third and fourth factors, similarly, by driving not only the piezoelectric element 18 corresponding to the ejection nozzles but also simultaneously driving the piezoelectric element 18 corresponding to the idle nozzles by the non-ejection driving signal, it is possible to suppress the variation in ejection characteristic such as the deterioration of the flight speed of the ink droplets or the reduction of the amount of ink droplets regardless of the number of ejection nozzles and to prevent crosstalk. Accordingly, it is possible to make the ejection characteristic of the ink droplets constant.

Even when the number of idle nozzles for performing the non-ejection driving is increased, the reduction of the pressure loss (crosstalk) generated through the reservoir 17 is saturated. Accordingly, the piezoelectric elements 18 corresponding to all the idle nozzles do not need to perform the non-ejection driving.

Figure 5:
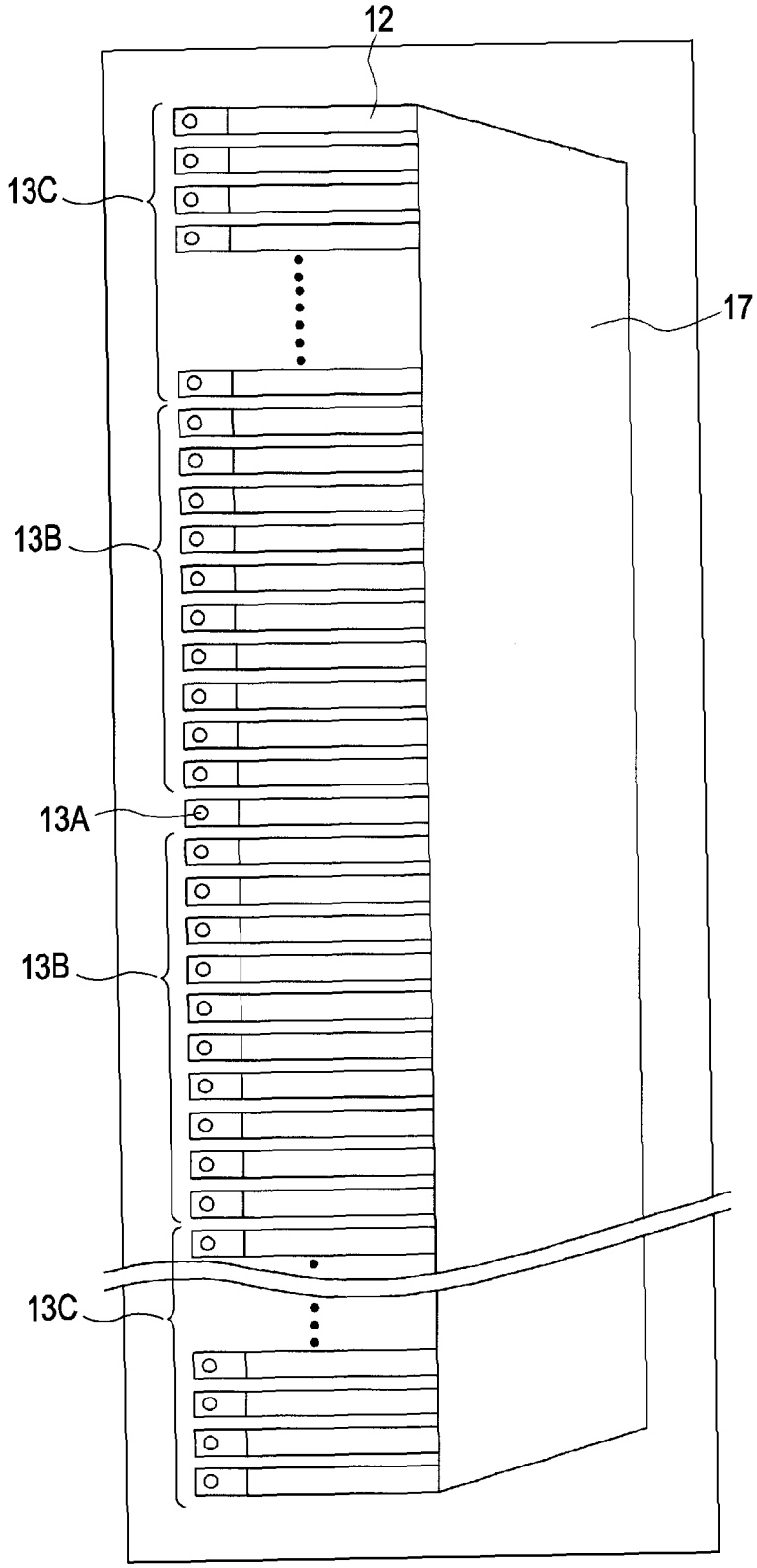
FIG. 5 is a plan view showing ejection nozzles and idle nozzles according to Embodiment 1 of the invention.

In the present embodiment, as shown in FIG. 5, the number of idle nozzles 13B corresponding to the piezoelectric element 18 for performing the non-driving, which are located at each of both sides of the ejection nozzle 13A for ejecting the ink droplet, is 10, that is, the number of idles nozzles located at one side of the ejection nozzle 13A is 10. The non-ejection pulse is not supplied to the piezoelectric elements 18 corresponding to the other idle nozzles 13B such that the non-driving in which the state is held is performed. In addition, the number of idle nozzles 13B for performing the non-ejection driving is properly set to a degree that the variation in ink ejection characteristic can be reduced, according to the structure of the ink jet recording head 10, the viscosity of the ink or the like.

The number of idle nozzles 13B to which the second driving signal COM2 (non-ejection driving signal) is supplied was changed, the ink flight speed when the ink droplet is ejected from one nozzle opening 13 and the ink flight speed when the ink droplets are ejected from all the nozzle openings 13 were measured, and a speed difference (speed ratio) was calculated. This result is shown in FIG. 6.

Figure 6:
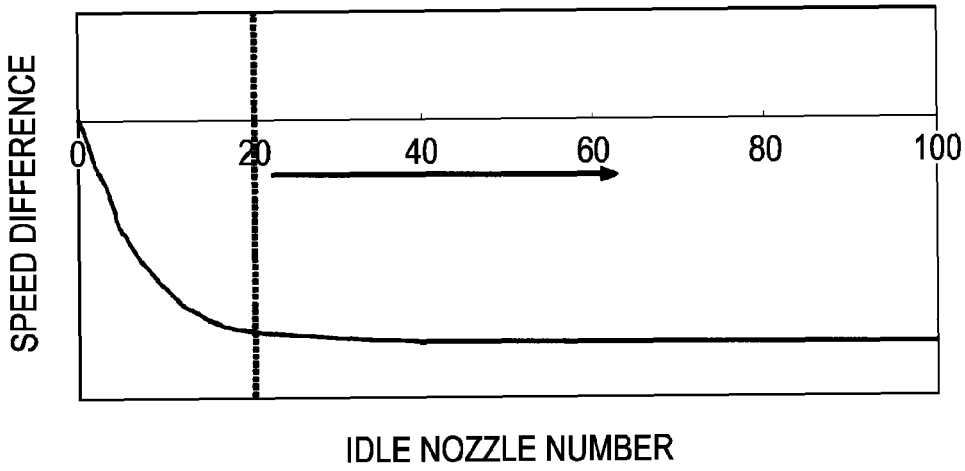
FIG. 6 is a graph showing a relationship between the number of idle nozzles and a speed difference according to Embodiment 1.

As shown in FIG. 6, when the number of idle nozzles 13B is eight at one side of the ejection nozzle 13A, that is, a total of 16 or more places at both sides of the ejection nozzle 13A, the speed difference of the flight speed of the ink droplets is saturated. Accordingly, when the number of idle nozzles is 10 at one side of the ejection nozzle 13A (the number of idle nozzles is a total of 20 at both sides of the ejection nozzle), it can be seen that the speed difference of the flight speed of the ink droplets is saturated with certainty. Accordingly, the number of second driving signals COM2 is preferably 8 (a total of 16) or more at one side of the ejection nozzle 13A and is more preferably 10 (a total of 20) or more. As described above, even when the number of idle nozzles 13B to which the second driving signal COM2 is supplied is 10 or more at one side of the ejection nozzle 13A, since the effect of reducing the speed difference of the flight speed of the ink droplets is not changed, it can be seen that the second driving signal COM2 does not need to be supplied to all the idle nozzles 13B and 13C.

As described above, the idle nozzles 13B including at least one located adjacent to the ejection nozzle 13A in the vicinity of the ejection nozzle 13A are selected, the piezoelectric element 18 corresponding to the selected idle nozzles 13B performs the non-ejection driving, and the piezoelectric element 18 corresponding to the unselected idle nozzles 13C does not perform the non-ejection driving, that is, performs the non-driving. Accordingly, it is possible to reduce a variation in ink ejection characteristic regardless of a difference in the number of ejection nozzles 13A or a difference in position of the ejection nozzle 13A. The piezoelectric element 18 corresponding to the idle nozzles 13C is not driven by the second driving signal COM2 such that power consumption can be reduced. That is, if the piezoelectric elements 18 corresponding to all the idle nozzles 13B and 13C perform the non-ejection driving, power consumption is increased. However, when the piezoelectric elements 18 corresponding to all the idle nozzles 13B and 13C do not perform the non-ejection driving and only the piezoelectric element 18 corresponding to the idle nozzles 13B in the vicinity of the ejection nozzle 13A performs the non-ejection driving, the same effect as when the non-ejection driving is performed with respect to all the idle nozzles 13B and 13C can be obtained. Therefore, it is possible to reduce power consumption by performing the non-driving in which the piezoelectric element 18 corresponding to the unselected idle nozzles 13C does not perform the non-ejection driving.

In the present embodiment, since the non-ejection driving is performed using the counter pulse CP which can be obtained by reducing the driving voltage of the ejection pulse DP to a degree not ejecting the ink droplets from the nozzle openings 13, it is possible to match timings in which the pressure in the pressure generation chamber 12 is changed by the ejection nozzle 13A and the idle nozzles 13B and to more efficiently suppress the pressure loss.

Embodiment 2

Figure 7:
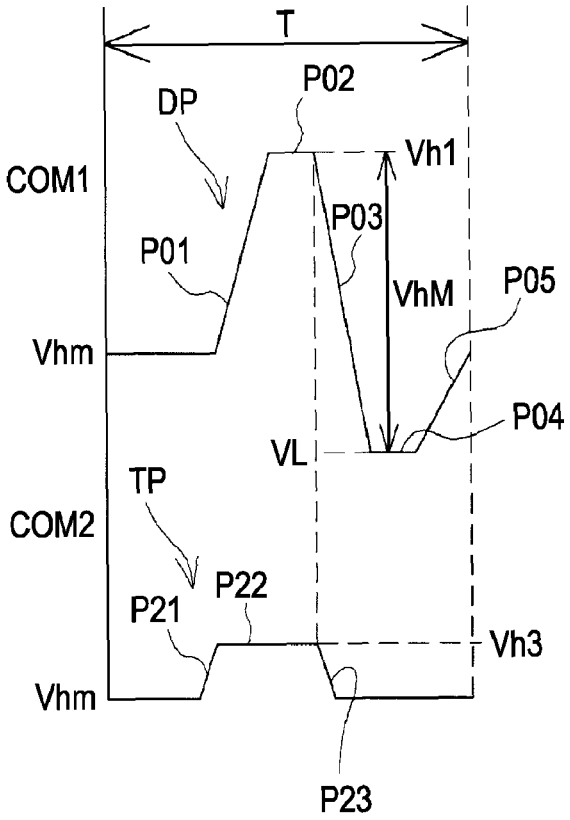
FIG. 7 is a waveform diagram showing an example of a driving signal according to Embodiment 2 of the invention.

FIG. 7 is a waveform diagram showing an example of a driving signal according to Embodiment 2 of the invention. The same members as Embodiment 1 are denoted by the same reference numerals and the overlapping description will be omitted.

As shown in FIG. 7, the driving signal of the present embodiment includes a first driving signal COM1 and a second driving signal COM2.

The first driving signal COM1 has an ejection pulse DP similar to Embodiment 1 and the second driving signal COM2 has a trapezoidal pulse TP having a trapezoidal shape by changing a counter pulse CP as a non-ejection pulse.

The trapezoidal pulse TP which is the non-ejection pulse includes a third expansion element P21 for rising from a state of holding an intermediate potential Vhm to a third expansion potential Vh3 so as to expand the pressure generation chamber 12, a fifth hold element P22 for holding the third expansion potential Vh3, and a third contraction element P23 for returning from the third expansion potential Vh3 to the intermediate potential Vhm to a degree not ejecting the ink droplets.

In the trapezoidal pulse TP, the supply timing of the third contraction element P23 is matched to the supply timing of the contraction element (first contraction element P03) for contracting the pressure generation chamber 12 of the ejection pulse DP corresponding thereto. That is, the pressurization to the ink in the pressure generation chamber 12 is simultaneously performed by the ejection nozzle 13A and the selected idle nozzles 13B. The second driving signal COM2 having such a trapezoidal pulse TP is supplied to the piezoelectric element 18 corresponding to the idle nozzles 13B including at least one located adjacent to the ejection nozzle 13A in the vicinity of the ejection nozzle 13A and is not supplied to the piezoelectric element 18 corresponding to the unselected idle nozzles 13C, similar to above-described Embodiment 1.

Even when such a trapezoidal pulse TP is used, similar to above-described Embodiment 1, it is possible to reduce pressure loss and to prevent crosstalk, to uniformize the ink ejection characteristic, and to reduce power consumption.

In such a trapezoidal pulse TP, a minute vibration pulse BP used for minutely vibrating the meniscuses of the nozzle openings 13 at a predetermined interval or before and after the ejection of the ink droplets and agitating the ink thickened by dry may be used and a trapezoidal pulse TP different from the minute vibration pulse may be used. In addition, the minute vibration driving of the piezoelectric element 18 using the minute vibration pulse is generally used, the existing minute vibration pulse is used by supplying this minute vibration pulse to the idle nozzles 13B according to the supply timing of the ejection pulse, and a simple design change is performed with respect to the existing ink jet recording apparatus which can perform the ejection control using the plurality of driving signals, such that a configuration which can reduce pressure loss and reduce power consumption is realized.

Embodiment 3

Figure 8A:
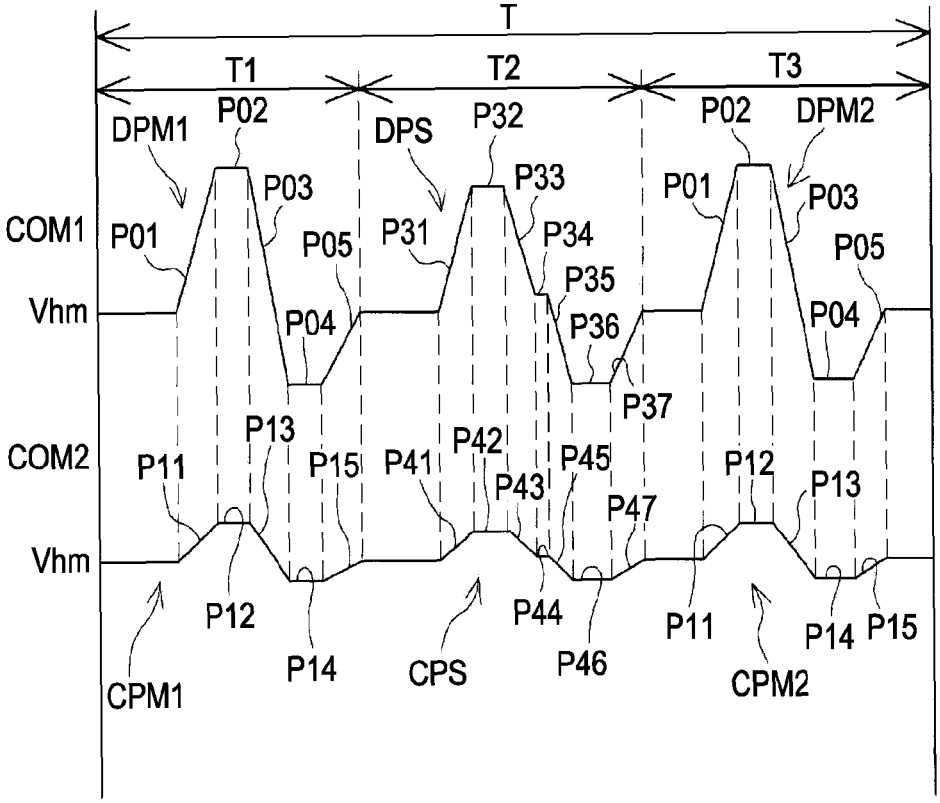
FIGS. 8A-8B are waveform diagrams showing an example of a driving signal according to Embodiment 3 of the invention.
Figure 8B:
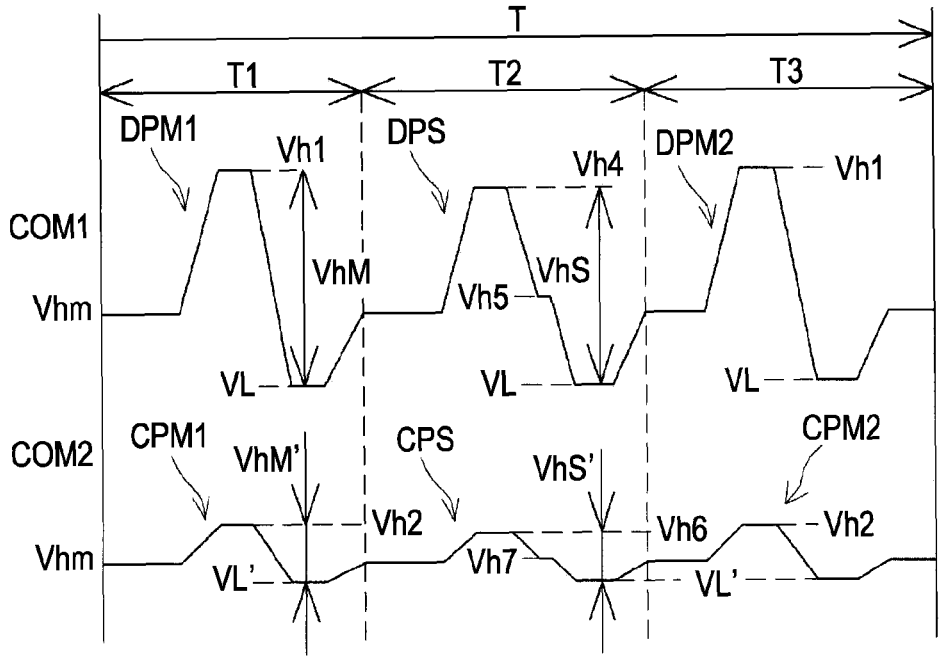

Although, in Embodiments 1 and 2, one ejection pulse and one non-ejection pulse are provided in one recording period T as the first driving signal COM1 and the second driving signal COM2, two or more ejection pulses or non-ejection pulses may be provided in one recording period T. Now, an example of providing two or more ejection pulses and non-ejection pulses in one recording period T will be described. In addition, FIGS. 8 and 9 are waveform diagrams showing driving signals according to Embodiment 3 of the invention. The same members as Embodiment 1 are denoted by the same reference numerals and the overlapping description will be omitted.

As shown in FIG. 8, the first driving signal COM1 includes a first middle dot ejection pulse DPM1 having the same waveform shape as the above-described ejection pulse DP generated in a period T1 of one recording period T as the ejection pulse, a small dot ejection pulse DPS generated in a period T2, and a second middle dot ejection pulse DPM2 having the same waveform shape as the above-described ejection pulse DP generated in a period T3.

The small dot ejection pulse DPS of the first driving signal COM1 includes a fourth expansion element P31 for rising from an intermediate potential Vhm to a fourth expansion potential Vh4, a sixth hold element P32 for holding the fourth expansion potential Vh4, a fourth contraction element P33 for falling from the fourth expansion potential Vh4 to a third contraction potential Vh5, a seventh hold element P34 for holding the third contraction potential Vh5, a fifth contraction element P35 for falling from the third contraction potential Vh to a first contraction potential VL, an eighth hold element P36 for holding the first contraction potential VL, and a fifth expansion element P37 for rising from the first contraction potential VL to the intermediate potential Vhm.

When the small dot ejection pulse is supplied to the piezoelectric element 18, the pressure generation chamber 12 expands from a reference element to an expansion volume corresponding to the fourth expansion potential Vh4 by the fourth expansion element P31. Accordingly, the meniscus is drawn into the pressure generation chamber 12, and the ink is supplied from the reservoir 17 to the pressure generation chamber 12. The expansion state of the pressure generation chamber 12 is held by the sixth hold element P32. At this time, the central portion of the meniscus is inverted in the ejection direction and is swelled in a columnar shape. Thereafter, the pressure generation chamber 12 contracts by the fourth contraction element P33. Accordingly, the growth of the columnar portion of meniscus is prompted. After the seventh hold element P34 is held during a short time, the pressure generation chamber 12 contracts again by the fifth contraction element P35 such that ink droplets having small dots are ejected. The next operation to be performed is similar to that of the middle dot ejection pulses DPM1 and DPM2.

The second driving signal COM2 includes a first middle counter pulse CPM1, a small counter pulse CPS and a second middle counter pulse CPM2 which respectively correspond to the ejection pulses DPM1, DPS and DPM2.

The first middle counter pulse CPM1 and the second middle counter pulse CPM2 have the same waveform shape as the counter pulse CP of Embodiment 1.

The small counter pulse CPS includes a sixth expansion element P41 for rising from an intermediate potential Vhm to a sixth expansion potential Vh6 to expand the pressure generation chamber 12, a ninth hold element P42 for holding the sixth expansion potential Vh6, a sixth contraction element P43 for falling from the sixth expansion potential Vh6 to a sixth contraction potential Vh7, a tenth hold element P44 for holding the sixth contraction potential Vh7 during a short time, a seventh contraction element P45 for falling from the sixth contraction potential Vh7 to a second contraction potential VL', an eleventh hold element P46 for holding the second contraction potential VL', and a seventh expansion element P47 for rising from the second contraction potential VL' to the intermediate potential Vhm.

The generation periods of the waveform elements P41 to P47 of the small counter pulse CPS are respectively equal to those of the waveform elements P31 to P37 of the small dot ejection pulse DPS, as shown in FIG. 8. A driving voltage VhS' of the small counter pulse CPS is set to 10 to 50% of a driving voltage VhS of the small dot ejection pulse DPS. Accordingly, the inclination of the waveform elements P41, P43, P45 and P47 are more moderate than the inclination of the waveform elements P31, P33, P35 and P37 corresponding thereto.

Figure 9A:
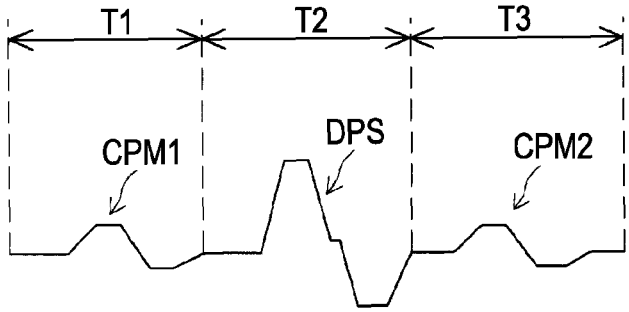
FIGS. 9A-9D are waveform diagrams showing an example of a driving signal according to Embodiment 3 of the invention.

When the small dots are recorded using such driving signals COM1 and COM2, as shown in FIG. 9A, the small dot ejection pulse DPS generated in the period T2 of the first driving signal COM1 is supplied to the piezoelectric element 18. In the other periods T1 and T3, the first middle counter pulse CPM1 and the second middle counter pulse CPM2 of the second driving signal COM2 are supplied to the piezoelectric element 18. Alternatively, in the periods T1 and T3, the non-ejection pulse may not be supplied and the intermediate potential Vhm may be held.

Figure 9B:
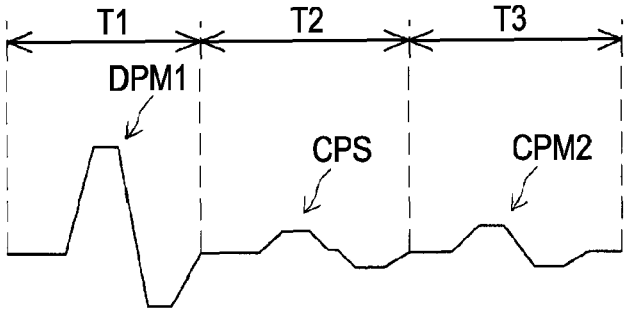

When the middle dots are recorded, as shown in FIG. 9B, the first middle dot ejection pulse DPM1 generated in the period T1 of the first driving signal COM1 is supplied to the piezoelectric element 18. In addition, in the other periods T2 and T3, the small counter pulse CPS and the second middle counter pulse CPM2 of the second driving signal COM2 are supplied to the piezoelectric element 18. Alternatively, in the periods T2 and T3, the non-ejection pulse may not be supplied and the intermediate potential Vhm may be held.

Figure 9C:
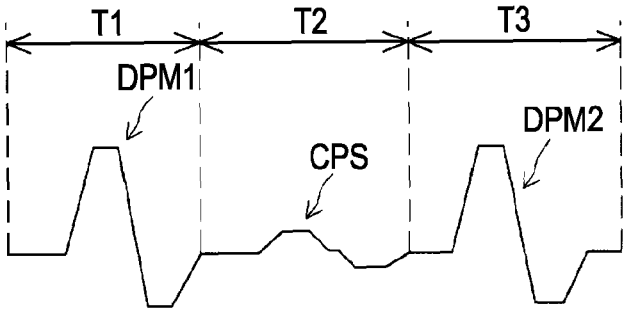

When the large dots are recorded, as shown in FIG. 9C, the first middle dot ejection pulse DPM1 generated in the period T1 and the second middle dot ejection pulse DPM2 generated in the period T3 of the first driving signal COM1 are supplied to the piezoelectric element 18. In the other period T2, the small counter pulse CPS of the second driving signal COM2 is supplied to the piezoelectric element 18. Alternatively, in the period T2, the non-ejection pulse may not be supplied and the intermediate potential Vhm may be held.

Figure 9D:
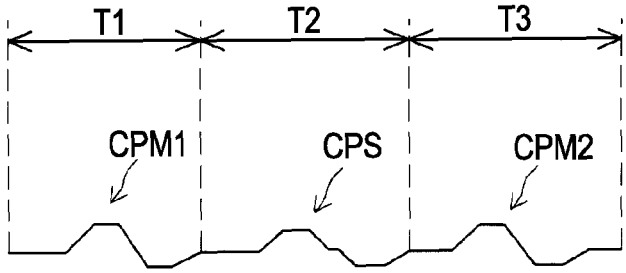

Meanwhile, as shown in FIG. 9D, in the periods T1 to T3, the non-ejection pulses CPM1, CPS and CPM2 are selectively supplied to the piezoelectric element 18 corresponding to the idle nozzles including one located adjacent to the ejection nozzle in the vicinity of the ejection nozzle in the idle nozzles which do not perform the recording in one recording period T. Alternatively, the non-ejection pulses CPM1, CPS and CPM2 may be supplied in all the periods T1 to T3 or the non-ejection pulses CPM1, CPS and CPM2 may be selectively supplied in the periods T1 to T3.

For example, if the small dot is recorded by one nozzle opening 13 of two adjacent nozzle openings 13 in one recording period T and the large dot is recorded by the other nozzle opening 13, the driving signal shown in FIG. 9A is supplied to the piezoelectric element 18 corresponding to the nozzle opening 13 for recording the small dot and the driving signal shown in FIG. 9C is supplied to the piezoelectric element 18 corresponding to the nozzle opening 13 for recording the large dot.

Accordingly, in the period T1, since the nozzle opening 13 for recording the large dot becomes the ejection nozzle 13A and the nozzle opening 13 for recording the small dot in the period T2 becomes the idle nozzle 13B, the first middle counter pulse CMP1 is supplied to the piezoelectric element 18 corresponding to the nozzle opening 13 for recording the large dot.

Accordingly, in the period T2, since the nozzle opening 13 for recording the small dot becomes the ejection nozzle 13A and the nozzle opening 13 for recording the large dot becomes the idle nozzle 13B, the small counter pulse CPS is supplied to the piezoelectric element 18 corresponding to the nozzle opening 13 for recording the small dot. Similarly, in the period T3, the second middle counter pulse CPM2 is supplied to the piezoelectric element 18 corresponding to the nozzle opening 13 for recording the large dot.

That is, if the above-described first driving signal COM1 and second driving signal COM2 are used, in the periods T1 to T3, the ejection pulses and the non-ejection pulses can be supplied at timings of the ejection nozzles 13A and the idle nozzles 13B.

For example, when the small dot is recorded by one nozzle opening 13 of two adjacent nozzle openings 13 in one recording period T and the recording is not performed by the other nozzle opening 13, the small dot ejection pulse DPS may be supplied in the period T2 and neither of the ejection pulse and the non-ejection pulse may be supplied in the periods T1 and T3, to the piezoelectric element 18 corresponding to the nozzle opening 13 for recording the small dot. The small counter pulse CPS may be supplied in the period T2 and neither of the ejection pulse and the non-ejection pulse may be supplied in the periods T1 and T2, to the other nozzle opening 13 which does not perform the recording. The non-ejection pulses such as the counter pulses CPM1, CPS, CPM2 and so on do not need to be always supplied in all the periods T1 to T3 of the idle nozzles 13B which do not perform the ejection of the ink droplets and the non-ejection pulses may be supplied according to the timing in which the ejection pulse is supplied to the adjacent nozzle opening 13. Alternatively, in the periods T1 and T3 of the ejection nozzle 13A or the period T2 of the idle nozzles 13B, the non-ejection pulses may be supplied.

The non-ejection driving which is performed by the piezoelectric element 18 by supplying the non-ejection pulses is, similar to Embodiments 1 and 2, performed by only the piezoelectric element 18 corresponding to the selected idle nozzles 13B, by selecting the idle nozzles 13B including at least one located adjacent to the ejection nozzle 13A in the vicinity of the ejection nozzle 13A of the idle nozzles 13B and 13C, and the non-driving without supplying the idle pulses is performed by the piezoelectric element 18 corresponding to the nozzles excluding the selected idle nozzles 13B, that is, the unselected idle nozzles 13C. In addition, the idle nozzles 13B for performing the non-ejection driving may be the nozzle openings 13 to which the ejection pulse is not supplied in all the periods T1 to T3 in one recording period T or the nozzle openings 13 to which the ejection pulse is supplied in the period of one recording period T but the ejection pulse is not supplied in the other period. That is, the non-ejection driving or the non-driving may be performed with respect to the nozzles to which the ejection pulse is not supplied in the periods T1 to T3 of one recording period T as the idle nozzles 13B and 13C or, without defining one recording period T, the non-ejection driving or the non-driving may be performed by defining the idle nozzles at the timing in which the ejection pulse of the nozzle openings 13 having a period in which the ejection pulse is supplied in one recording period T and having a period in which the ejection pulse is not supplied in the other period.

Without defining one recording period T, the idle nozzles 13B and 13C are defined at the timings of the periods T1 to T3 and the non-ejection driving is performed by the piezoelectric element 18 corresponding to the idle nozzles 13B such that the meniscus can be vibrated by the non-ejection driving during intervals of the ejection driving and thus thickening due to the dry of the ink can be prevented. That is, if only the nozzle openings 13 to which the ejection pulse is not supplied in one recording period T are the idle nozzles 13B, the non-ejection pulse is not supplied to and the intermediate potential Vhm is held at the piezoelectric element 18 corresponding to the ejection nozzle 13A during the intervals of the ejection driving. Accordingly, in order to supply the non-ejection pulse in the periods T1 to T3 during the intervals of the ejection driving, the idle nozzles 13B need to be defined at the timing of the periods T1 to T3. If only the nozzle openings 13 to which the ejection pulse is not supplied in one recording period T is defined as the idle nozzles 13B, since the non-ejection pulse is not supplied during the period in which the ejection pulse is supplied, the effect that power consumption can be reduced can be obtained.

Although, in the present embodiment, the first driving signal COM1 includes different ejection pulses DPM1, CPS and DPM2 and the second driving signal COM2 includes the non-ejection pulses CPM1, CPS and CPM2 corresponding to the ejection pulses DPM1, CPS and DPM2, but not specially limited thereto. For example, the ejection pulses and the non-ejection pulses of the first driving signal COM1 and the second driving signal COM2 may be mixed. As the non-ejection pulse, the same trapezoidal pulse TP as Embodiment 2 may be used.

Other Embodiments

Although the embodiments of the invention are described, the basic configuration of the invention is not limited to the above-described configuration. For example, a minute vibration pulse for performing minute vibration before ejection, which drives the piezoelectric element 18 to a degree not ejecting the ink, may be provided in the above-described driving signal COM1. As the minute vibration pulse, the counter pulse or the trapezoidal pulse may be used. The number of timings in which the minute vibration pulse is inserted may be only the first one time in one recording period T and the minute vibration pulse may be inserted between the ejection pulses.

Although, in Embodiments 1 to 3, the longitudinal vibration piezoelectric element 18 is used as the pressure generation unit, the pressure generation unit is not specially limited to this. For example, deflection piezoelectric element in which a lower electrode, a piezoelectric layer and an upper electrode are laminated may be used. In addition, when the longitudinal vibration piezoelectric element 18 is used, the piezoelectric element 18 longitudinally contracts by the charging so as to expand the pressure generation chamber 12 and the piezoelectric element 18 longitudinally expands by the discharging so as to contract the pressure generation chamber 12. In contrast, when the deflection piezoelectric element is used as the pressure generation unit, the piezoelectric element is deformed to the side of the pressure generation chamber 12 by the charging so as to contract the pressure generation chamber 12 and the piezoelectric element is deformed to the side opposite to the pressure generation chambers 12 by the discharging so as to expand the pressure generation chamber 12. The driving signals for driving such a piezoelectric element have a potential polarity inverted from that of the above-described driving signals COM1 and COM2.

In addition, a so-called electrostatic actuator for generating static electricity between the vibration plate and the electrode, deforming the vibration plate by electrostatic force, and ejecting liquid droplets from the nozzle openings 13 may be used as the pressure generation units.

Although, in the above-described ink jet recording apparatus I, the ink jet recording head 10 (the head units 1A and 1B) is mounted in the carriage 3 and is moved in the main scanning direction, the configuration is not specially limited to this. For example, the invention is applicable to a so-called line type recording apparatus for performing printing by moving only a recording sheet S such as paper in the sub scanning direction in a state in which the ink jet recording head 10 is fixed.

The invention relates to overall liquid ejecting heads and is applicable to a recording head such as various kinds of ink jet recording heads used in an image recording apparatus such as a printer; coloring material ejecting head used for manufacturing color filters of a liquid crystal display and the like; an electrode material ejecting head used for forming electrodes of an organic EL display, a field emission display (FED) and the like; a bio-organic matter ejecting head used for manufacturing biochips; and the like. In addition, a liquid ejecting apparatus in which such a liquid ejecting head is mounted is not specially limited.

The entire disclosure of Japanese Patent Application No: 2008-084658, filed Mar. 27, 2008 is expressly incorporated by reference herein.

What is claimed is:

1. A liquid ejecting apparatus comprising:

pressure generation chambers communicating with nozzle openings for ejecting a liquid; and a liquid ejecting head including pressure generation units which cause pressure variations in the pressure generation chambers, wherein idle nozzles including at least one located adjacent to ejection nozzles in the vicinity of the ejection nozzles are selected according to a liquid ejecting timing from the ejection nozzles for ejecting the liquid from the nozzle openings, the pressure generation unit corresponding to the selected idle nozzles is driven, non-ejection driving for pressurizing the pressure generation chamber communicating with the idle nozzles to a degree not ejecting the liquid is performed, and the non-ejection driving is not performed with respect to the pressure generation unit corresponding to the unselected idle nozzles.

2. The liquid ejecting apparatus according to claim 1, wherein the non-ejection driving is performed with respect to the pressure generation unit corresponding to 10 idle nozzles at both sides of each of the ejection nozzles.

3. The liquid ejecting apparatus according to claim 1, further comprising a driving signal generation unit which simultaneously and repeatedly generates a plurality of driving signals in every ejection period and a selection supply unit which selects pulses included in the driving signals generated from the driving signal generation unit and supplies the pulses to the pressure generation unit, wherein the driving signal generation unit generates a non-ejection driving signal including non-ejection pulses for causing the pressure variation to a degree not ejecting the liquid from the nozzle openings in the liquid of the pressure generation chamber, in the non-ejection driving signal, the non-ejection pulses are arranged in correspondence with the ejection pulses included in another driving signal, and the selection supply unit supplies the non-ejection pulses to the pressure generation unit corresponding to the selected idle nozzles according to the supply timing of the ejection pulses to the pressure generation unit corresponding to the ejection nozzles.

4. The liquid ejecting apparatus according to claim 3, wherein the driving signal generation unit generates different types of ejection pulses and arranges the non-ejection pulses in correspondence with the generation periods of the ejection pulses.

5. The liquid ejecting apparatus according to claim 3, wherein the timing of a contraction element of the pressure generation chamber by the non-ejection pulses is aligned with the timing of a contraction element of the pressure generation chamber of the ejection pulses corresponding thereto.

6. The liquid ejecting apparatus according to claim 3, wherein the non-ejection pulses are minute vibration pulses for minutely vibrating the surface of the liquid exposed by the nozzle openings to a degree not ejecting the liquid.

7. The liquid ejecting apparatus according to claim 3, wherein the non-ejection pulses are counter pulses for reducing the driving voltage of the ejection pulses corresponding thereto to a degree not ejecting the liquid.

8. A method of driving a liquid ejecting head including pressure generation chambers communicating with nozzle openings for ejecting a liquid, and a liquid ejecting head including pressure generation units which cause pressure variations in the pressure generation chambers, wherein idle nozzles including at least one located adjacent to ejection nozzles in the vicinity of the ejection nozzles are selected according to a liquid ejecting timing from the ejection nozzles for ejecting the liquid from the nozzle openings, the pressure generation unit corresponding to the selected idle nozzles is driven, non-ejection driving for pressurizing the pressure generation chamber communicating with the idle nozzles to a degree not ejecting the liquid is performed, and the non-ejection driving is not performed with respect to the pressure generation unit corresponding to the unselected idle nozzles.

* * * * *